US006247861B1

(12) United States Patent
Wotton

(10) Patent No.: US 6,247,861 B1
(45) **Date of Patent: *Jun. 19, 2001**

(54) CONTROLLING VACUUM HOLD OF MEDIA IN A PRINTER

(75) Inventor: Geoff Wotton, Battleground, WA (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/324,688

(22) Filed: Jun. 3, 1999

(51) Int. Cl.[7] ..... B41J 13/02
(52) U.S. Cl. ..... 400/636.3; 400/627
(58) Field of Search ..... 400/636.3, 56, 400/708, 703, 711, 627, 629, 624, 578; 271/276, 275, 260

(56) References Cited

U.S. PATENT DOCUMENTS

| | | | | |
|---|---|---|---|---|
| 3,722,441 | | 3/1973 | Kitchener et al. | 112/205 |
| 3,954,260 | | 5/1976 | Morello et al. | 271/12 |
| 4,127,265 | * | 11/1978 | Wirz et al. | 271/260 |
| 4,222,556 | | 9/1980 | Chapman et al. | 271/3.1 |
| 4,298,277 | | 11/1981 | Silverberg | 355/76 |
| 4,369,964 | * | 1/1983 | Jinnai et al. | 271/260 |
| 4,420,150 | | 12/1983 | Umezawa | 271/11 |
| 4,504,843 | * | 3/1985 | Prohl et al. | 346/138 |
| 4,792,249 | | 12/1988 | Lahr | 400/578 |
| 4,840,369 | * | 6/1989 | Takahashi | 271/276 |
| 4,917,512 | | 4/1990 | Mimura | 400/56 |
| 5,108,205 | | 4/1992 | Stone | 400/56 |
| 5,156,464 | | 10/1992 | Sakai | 400/56 |
| 5,329,301 | * | 7/1994 | Balzeit et al. | 346/134 |
| 5,356,127 | | 10/1994 | Moore et al. | 271/11 |
| 5,391,051 | | 2/1995 | Sabatier et al. | 414/797.2 |
| 5,486,063 | * | 1/1996 | Fox et al. | 400/708 |
| 5,510,815 | | 4/1996 | Linder et al. | 347/8 |
| 5,797,597 | | 8/1998 | Kakuta et al. | 271/96 |
| 5,836,580 | | 11/1998 | Hansen et al. | 271/9.13 |
| 5,848,789 | | 12/1998 | Ochi et al. | 271/258.01 |
| 6,000,693 | | 12/1999 | Tranquilla | 271/263 |
| 6,015,146 | | 1/2000 | Siegel | 271/98 |
| 6,076,819 | | 6/2000 | Koike et al. | 271/3.07 |
| 6,123,330 | | 9/2000 | Schaal | 271/31 |

FOREIGN PATENT DOCUMENTS

| | | | | |
|---|---|---|---|---|
| 2026391 | * | 2/1980 | (GB) | 400/627 |

* cited by examiner

*Primary Examiner*—John S. Hilten
*Assistant Examiner*—Anthony H. Nguyen

(57) ABSTRACT

A system for regulating the vacuum hold pressure in a printer based upon the stiffness of the print media that is directed through the printer. In one embodiment, the stiffness of a sheet of media is detected before or as the sheet reaches the carrier. The vacuum pressure level is thus regulated in response to the stiffness measurement of the sheet, thereby to have applied to that particular media a level of vacuum pressure that prevents problems that arise when pressure levels are too low (for example, inadvertent shifting of the paper) or too high (for example, paper deformations that reduce print quality). A sensing technique for alternatively sensing stiffness and paper thickness is also provided.

20 Claims, 4 Drawing Sheets

CONTROLLING VACUUM HOLD OF MEDIA IN A PRINTER

TECHNICAL FIELD

This invention relates to systems that employ vacuum pressure for holding print media as the media is advanced through a hard copy device such as a printer.

BACKGROUND AND SUMMARY OF THE INVENTION

An inkjet printer includes one or more ink-filled pens that are mounted to a carriage in the printer body. Normally, the carriage is scanned across the width of the printer as paper or other print media is advanced through the printer. Each ink-filled pen includes a printhead that is driven to expel droplets of ink through an array of nozzles in the printhead toward the paper in the printer. The timing and nominal trajectory of the droplets are controlled to generate the desired text or image output and its associated quality.

As the sheet of print media is advanced through the printer, it must be secured so that high-resolution printing can occur. One method of holding the sheet is to direct it against an outside surface of a moving carrier such as perforated drum. Suction is applied to the inside surface of the carrier for holding the sheet against the moving carrier. The carrier is arranged to move the sheet into and out of a location adjacent to the pens that apply the ink to the sheet.

It is important to apply the proper level of suction to a system like the one just described. The suction, or vacuum pressure (here the term "vacuum" is used in the sense of a pressure less than ambient), must be applied at a level sufficient for ensuring that the sheet of print media remains in contact with the carrier. For example, should the edges of the sheet lift from the carrier as a result of too little vacuum pressure, there is a likelihood that the pen will collide with the edge, which is quite undesirable. Also, the vacuum pressure level must be high enough to hold the sheet flat, to eliminate wrinkling or cockling of the sheet during printing.

If the vacuum pressure level is too high, the surface of the sheet may become deformed in the vicinity of the perforations. As a result, the ink droplets will not strike the surface of the sheet as intended, and print quality will suffer. Also, power is wasted if the vacuum level is unnecessarily high.

Moreover, when liquid ink is applied to the sheet, it is important to ensure that the vacuum pressure level is not so high as to draw the ink completely through the sheet, such that the ink appears on the other side as an undesirable effect known as "strike through."

The foregoing considerations concerning vacuum levels are complicated by differences in the physical characteristics of the variety of print media that can be handled by modern printers. The print media can be thin, relatively lightweight cut paper, relatively thick or stiff media known as transparencies, heavy photo stock, etc. Also, media having the same thickness will not necessarily deform by the same amount for a given vacuum pressure level. For example, a sheet of transparency type media having a given thickness will not deform by the same amount as a sheet of paper having the same thickness. In short, one level of vacuum pressure will not be appropriate for the wide variety of print media available to a user.

The present invention is directed to a system for controlling or regulating the vacuum hold pressure in a printer based upon the sensed stiffness of the print media that is directed through the printer.

In one preferred embodiment of the invention, the deflection of the print media is sensed before or as the media reaches the carrier. The vacuum pressure level is regulated in response to this deflection measure, thereby to have applied to that particular media a level of vacuum pressure that is best (remove cockle, avoid strike through, etc.) for that media.

DETAILED DESCRIPTION OF PREFERRED EMBODIMENTS

Figure 1:
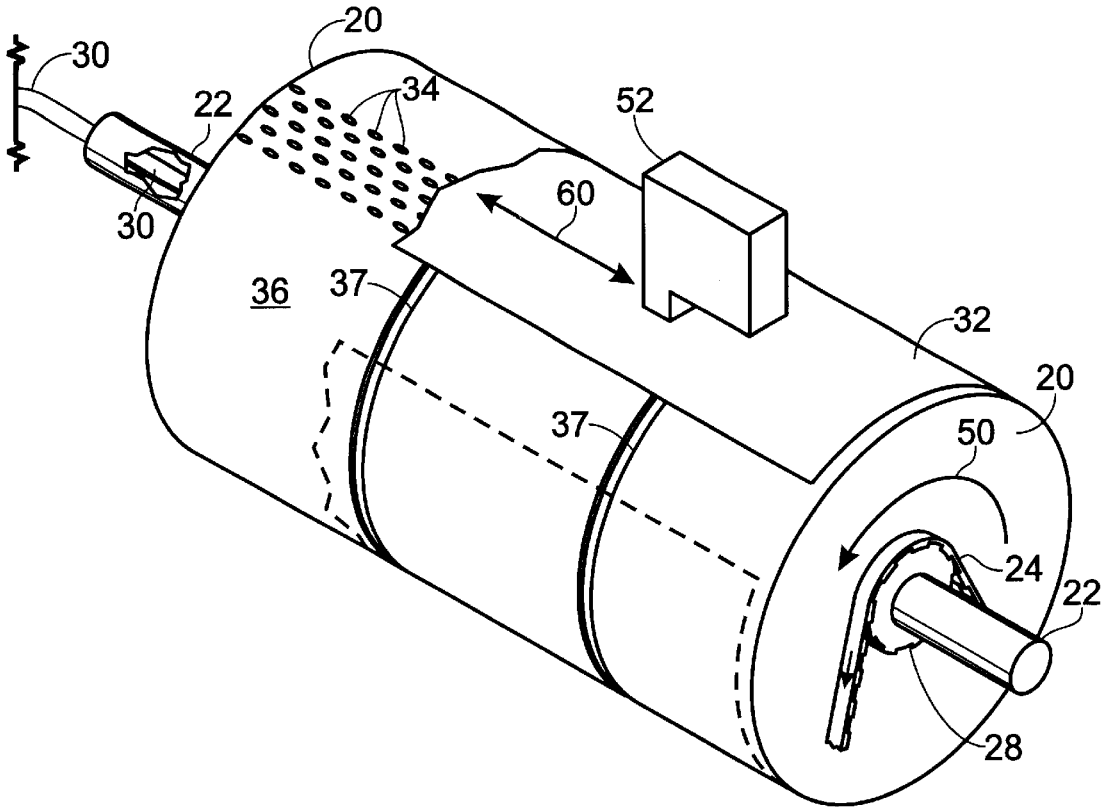
FIG. 1 is a perspective view of a print media carrier of a printer, which carrier is adaptable for use with the vacuum-hold control system of the present invention.
Figure 2:
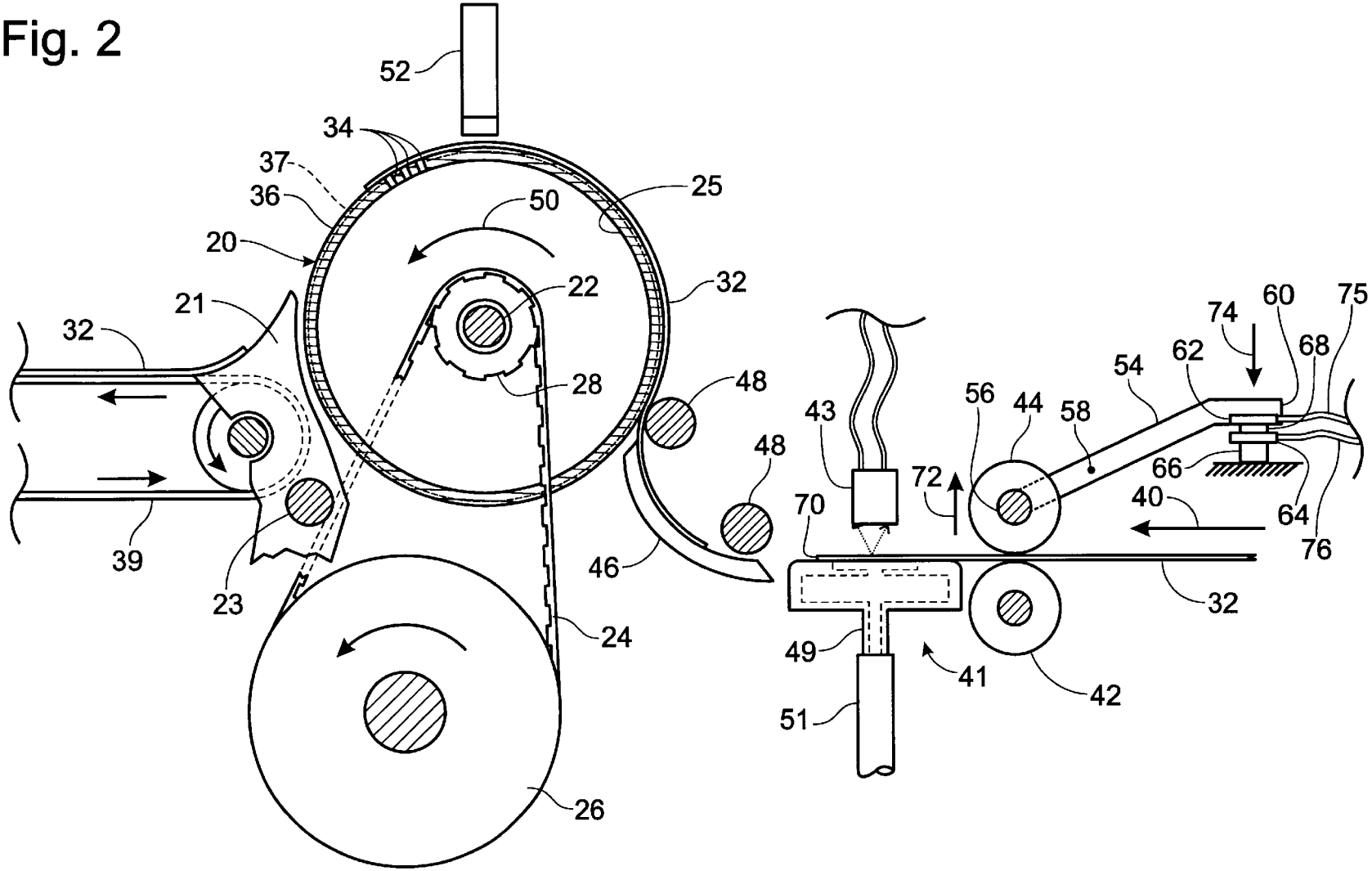
FIG. 2 is a side view of the media carrier, including media handling and sensing components of the present invention.

With reference to FIGS. 1 and 2, one preferred embodiment of the present invention is operable with a printer media carrier, such as a drum 20, that is supported by a shaft 22 within a printer. The drum 20 preferably has a circumference of about 50 cm, although any of a variety of drum sizes will suffice.

An endless drive belt 24 engages a gear 28 that is fixed to one end of the drum 20. That belt also engages a drive pulley 26 (FIG. 2). In a preferred embodiment, a motor (not shown) continuously drives the pulley 26 to rotate the drum whenever a printing operation is carried out.

Figure 4:
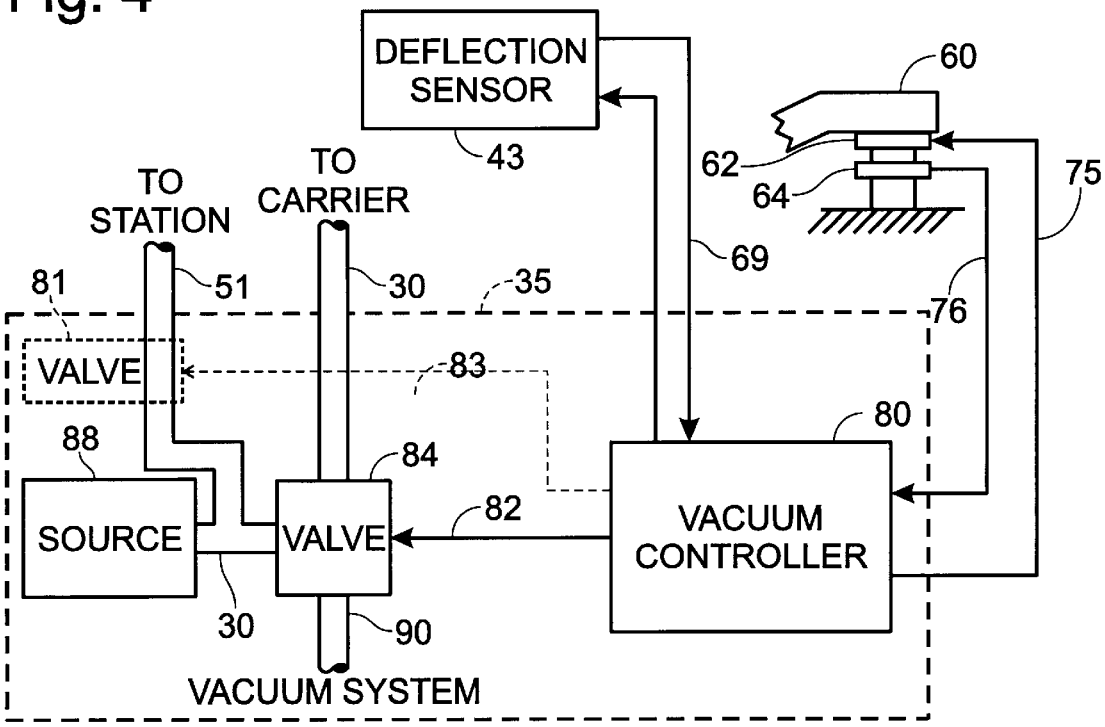
FIG. 4 is a block diagram of the present system.

The other end of the drum shaft 22 is hollow. A vacuum line 30 enters the hollow interior of the drum 20 through the shaft 22. The shaft has openings inside the drum to enable fluid communication between the end of the vacuum line and the drum interior. The other end of the vacuum line 30 is connected to a regulated vacuum system 35 (FIG. 4).

The vacuum is applied to the interior of the drum as a mechanism for securing print media, such as a sheet of paper 32, to the drum 20 as the paper is advanced through the printer over the drum. To this end, the drum is perforated with vacuum ports 34 that extend between the interior surface 25 of the drum and the outer surface 36 of the drum. The suction present in the ports 34 secures to the drum outer surface 36 the paper 32 that is directed into contact with the drum, as is described next.

FIG. 2 illustrates in somewhat simplified fashion a portion of the path of the paper 32 through the printer. It is noteworthy here that although the print medium will be hereafter referred to as "paper", any of a number of materials can be used as the medium in such printers, such as thin, relatively lightweight cut paper, relatively thick or stiff media known as transparencies, heavy photo stock, etc. As will be described, the present invention provides for regulating the vacuum system 35 so that a level of suction is applied by the vacuum system to match the physical characteristics of the paper; namely, the stiffness of the paper.

The paper 32 is picked from an input tray and driven into the paper path in the direction of arrow 40. The leading edge of the paper is fed into the nip between a drive roller 42 and an idler or pinch roller 44. Upon exiting the rollers 42, 44, the paper moves across a station 41 that senses the stiffness of the paper as described more fully below. From there the paper 32 is driven in a controlled manner into contact with a curved guide 46 that, in cooperation with guide rods 48, directs the leading edge of the paper 32 into tangential contact with the exterior surface 36 of the drum 20.

As the vacuum ports 34 of the drum rotate into contact with the paper 32, the suction established between the paper and drum secures ("loads") the paper to the drum, and the drum continues to rotate in the direction of arrow 50. The guide rods are retracted from contact with the paper as soon as the paper is loaded. The paper 32 on the drum is moved to a location adjacent to one or more pens 52 of the printer. The pens are controlled to apply ink to the paper during a printing operation.

Once the printing operation respecting a particular sheet of paper is complete (the paper may be rotated past the pens several times to complete the operation) the paper is removed from the drum. This can be carried out by the controlled, temporary movement of guide prongs 21 (FIG. 2) that pivot about a post 23 into circumferential grooves 37 that are formed in the drum. This redirects the paper from the drum to a conveyor belt 39 that delivers the paper to a collection tray.

In one preferred embodiment of the present invention, the thickness of the paper 32 may be detected just before the paper 32 reaches the station 41. To this end, a lever 54 is connected at one end to the shaft 56 of the pinch roller 44. The lever has pivotally connected between its ends a pivot 58, which is a fixed point relative to the printer. The remote end 60 of the lever has mounted to it an electrode 62 that faces another electrode 64 that is aligned with the first electrode 62 and is mounted to a fixed, electrically insulated pad 66 in the printer.

A deformable, conductive member 68 is located between and in contact with the two electrodes 62, 64. The member 68 is made of conductive rubber in which the electrical conductivity changes in proportion to the pressure applied to it. In this regard, a low voltage is applied via lead 75 to the movable electrode 62 by the vacuum controller 80 (FIG. 4). The controller is discussed more below. Another lead 76 connects the fixed electrode 64 with the vacuum controller. Thus, the magnitude of the signal appearing on line 76 to the vacuum controller corresponds to that applied on line 75, as affected by changes in the shape (i.e., conductivity) of the deformable member 68.

As the leading edge 70 of a sheet of paper 32 passes between the drive roller 42 and the pinch roller 44, the pinch roller 44 is lifted (arrow 72) by an amount corresponding to the thickness of the paper. As a result, the lever 54 rotates about pivot 58 such that the remote end 60 of the lever moves downwardly (arrow 74) and compresses the conductive member 68. The attendant change in the conductivity of the member 68 varies the signal appearing on line 76 (hereafter referred to as the thickness signal) to the vacuum controller 80. The location of the pivot 58 is selected to multiply the distance of roller 44 movement by an amount sufficient to provide measurable changes in the compression of the conductive member 68.

As the paper 32 passes across the station 41 a measure of its stiffness is made and provided to the vacuum controller 80. In this regard, the paper is deliberately deflected at the station 41 and a non-contact-type sensor 43 senses the amount of deflection. The particulars of one embodiment of the station 41 are best considered in connection with the detail view of FIG. 3.

The paper 32 is moved across the surface 45 of a platform 47 that makes up part of the station 41. The platform is the upper wall of an elongated, substantially hollow, bar-like member that extends across the width of the paper, perpendicular to the path of the paper. The underside of the station has at least one tubular stub 49 (FIG. 2) that is in fluid communication with the hollow interior of the station. The other end of the stub 49 is connected to a vacuum line 51 that connects (FIG. 4) with a constant level vacuum source that is discussed more below.

Figure 3:
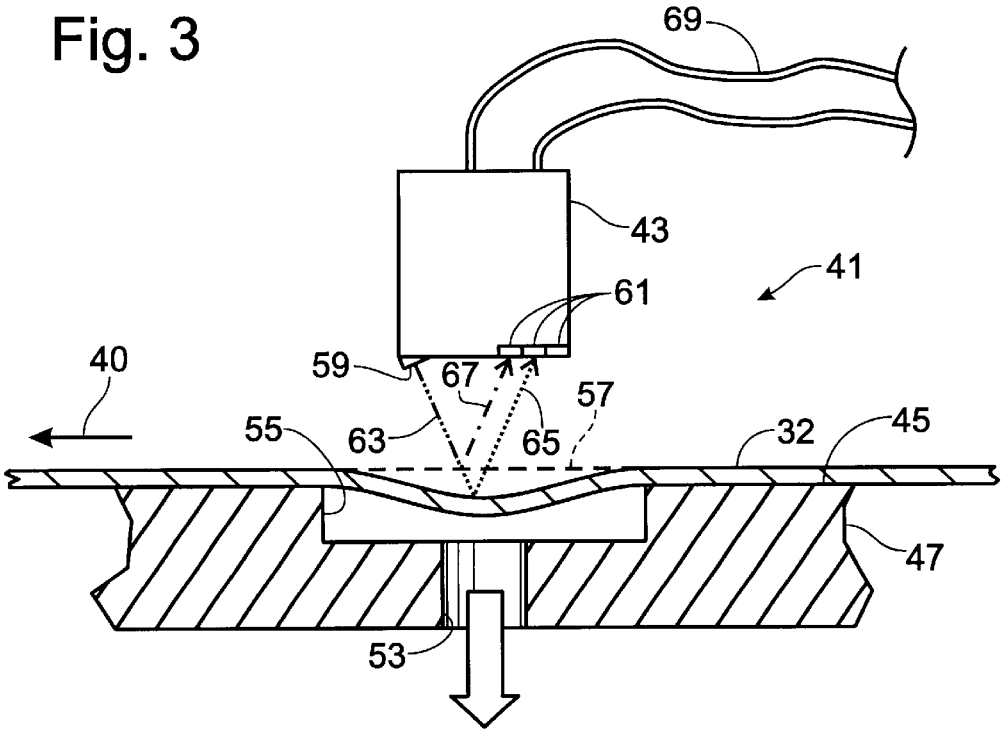
FIG. 3 an enlarged view of a media stiffness sensing station component of the present invention.

The vacuum pressure in the station 41 is communicated via one or more ports 53 to a channel 55 that is recessed in the surface 45 of the platform 47 (FIG. 3). The channel can be any of a variety of shapes, and need not extend across the width of the paper. In one preferred embodiment, the channel is generally rectangular, with its long sides extending in a direction parallel to the width of the paper 32 (i.e., into the plane of FIG. 3). The depth of the channel 55 (that is, the depth of the recess from the surface 45) is preferably about 10 to 12 mm. As noted, many other channel sizes will suffice for permitting deflection of at least part of the paper.

While part of the advancing paper 32 spans the channel 55, the suction in the channel causes the paper to deflect from the generally planar orientation (shown as dashed line 57) it would assume in the absence of the applied suction. The sensor 43 is located adjacent to the channel 55 and senses the amount of deflection of the part of the paper that spans the channel.

In particular, the non-contact type sensor 43 may be an optical type, including a light emitter 59 and an array of light detectors 61. The emitter 59 and detectors 61 are spaced apart. Light is directed via a beam 63 to be incident on the center of the channel, thereby to be reflected from the paper 32. Depending upon the amount of deflection of the paper 32, different ones of the array of detectors 61 will receive different amounts of light reflected from the paper. (Alternatively, a single light detector would receive a different amount of light, depending upon the amount of paper deflection.)

For instance, when the paper is deflected as shown in FIG. 3, the reflected light beam 65 strikes a different area in the light detector array than does a beam 67 that is reflected from a non-deflected surface 57 of the paper 32. Thus, different values of an output signal (hereafter referred to as the stiffness signal) will appear on the output lead 69 of the sensor 43, which signal is provided to the vacuum controller 80.

The vacuum controller 80 monitors the stiffness signal, as well as the above-described thickness signal, and adjusts the level of vacuum applied to the drum via line 30. In this regard, the vacuum controller 80 may be incorporated into the overall printer controller and include suitable analog to digital converters for receiving and processing the just described stiffness and thickness signals.

The vacuum controller 80 is also provided with suitable drivers for controlling via line 82 a conventional electronically controlled pneumatic valve 84. The valve 84 is connected to the vacuum line 30 that extends between a constant level vacuum source 88 and the drum 20. The valve 84 is also interconnected between the line 30 and an atmospheric vent 90. The valve is controlled by the controller 80 (as noted, in response to the thickness and stiffness signal) to open the vent 90 by an amount sufficient to alter (lower) the vacuum pressure in the line 30, hence in the interior of the drum 20. In this regard, the vacuum controller includes a look-up table or the like to correlate the stiffness signal and the thickness signal to the desired valve adjustment. This table can be empirically derived through tests of various media types.

One of ordinary skill will appreciate that there are many other ways available for adjusting the vacuum level applied to the drum. For instance, the vacuum source itself could be controllable (such as be varying fan speed) to increase or decrease the level as needed in response to the stiffness signal and the thickness signal.

Although separate thickness measuring mechanisms (lever 54, electrodes 62, 64 etc.) were described earlier, another preferred embodiment of the present invention employs the components associated with the station 41 to serve a dual purpose of measuring thickness of the paper 32 in conjunction with the stiffness (i.e., deflection) of the paper, thereby eliminating the need for separate mechanisms for measuring these two paper characteristics.

With particular reference to FIG. 3, the thickness of the paper 32 can be measured by the sensor 43 while no vacuum pressure is applied to the channel 55 (hence the uppermost surface of the paper 32 takes the planar orientation shown at 57). In this regard, the sensor may be first calibrated in any of a number of ways, such as by sensing the non-deflected thickness of a paper having a known thickness.

Calibration of the sensor is not required. That is, a true thickness measure is not required for the vacuum control aspects of the present invention. The comparison of the measurements of the non-deflected paper surface (vacuum off) and of the deflected surface (vacuum applied) suffices for controlling the vacuum level. Thus, even though the sensor output signal corresponding to the non-deflected paper surface is characterized as a "thickness" signal, one will appreciate that the thickness of the paper need not, in fact, be determined to implement this embodiment of the present invention.

As mentioned, the deflection of the paper is measured after the vacuum pressure is applied (via the source 88 through vacuum line 51) to the channel 55. In short, the vacuum pressure is cycled off and on during the time a particular sheet of paper spans the channel 55. To this end, the vacuum line 51 that extends from the vacuum source to the station is equipped with a electronically controlled valve 81 (FIG. 4) that is opened and closed by the vacuum controller 80 via control line 83. The valve 81 vents the line 51 to atmosphere when that valve is closed. Suction is applied to the line (hence to the channel 55) when the valve is opened.

Thus, for a given sheet of paper, a reflected light beam 67 (refer to FIG. 3) received on the detectors of the array 61 while the vacuum pressure in the channel is absent (i.e., valve 81 is closed) represents the thickness (or location of the non-deflected surface) of the paper, and a reflected light beam 65 received on the detectors of the array 61 while the vacuum pressure in the channel is present (i.e., valve 81 is open) represents the deflection of the paper. Therefore, the signal appearing on the sensor output lead 69 varies in time between the above defined thickness signal and stiffness signal.

It will be appreciated that, as another alternative, a separate, non-contact type sensor 43 could be employed as a paper thickness-measuring sensor. That is, a sensor otherwise like that 43 shown in FIG. 3 could be located adjacent to the platform 47 away from the channel 55 so that the part of the paper 32 underlying that second sensor remains supported on the surface 45 of the platform. As a result, only a paper thickness signal is generated by that second sensor.

Figure 5:
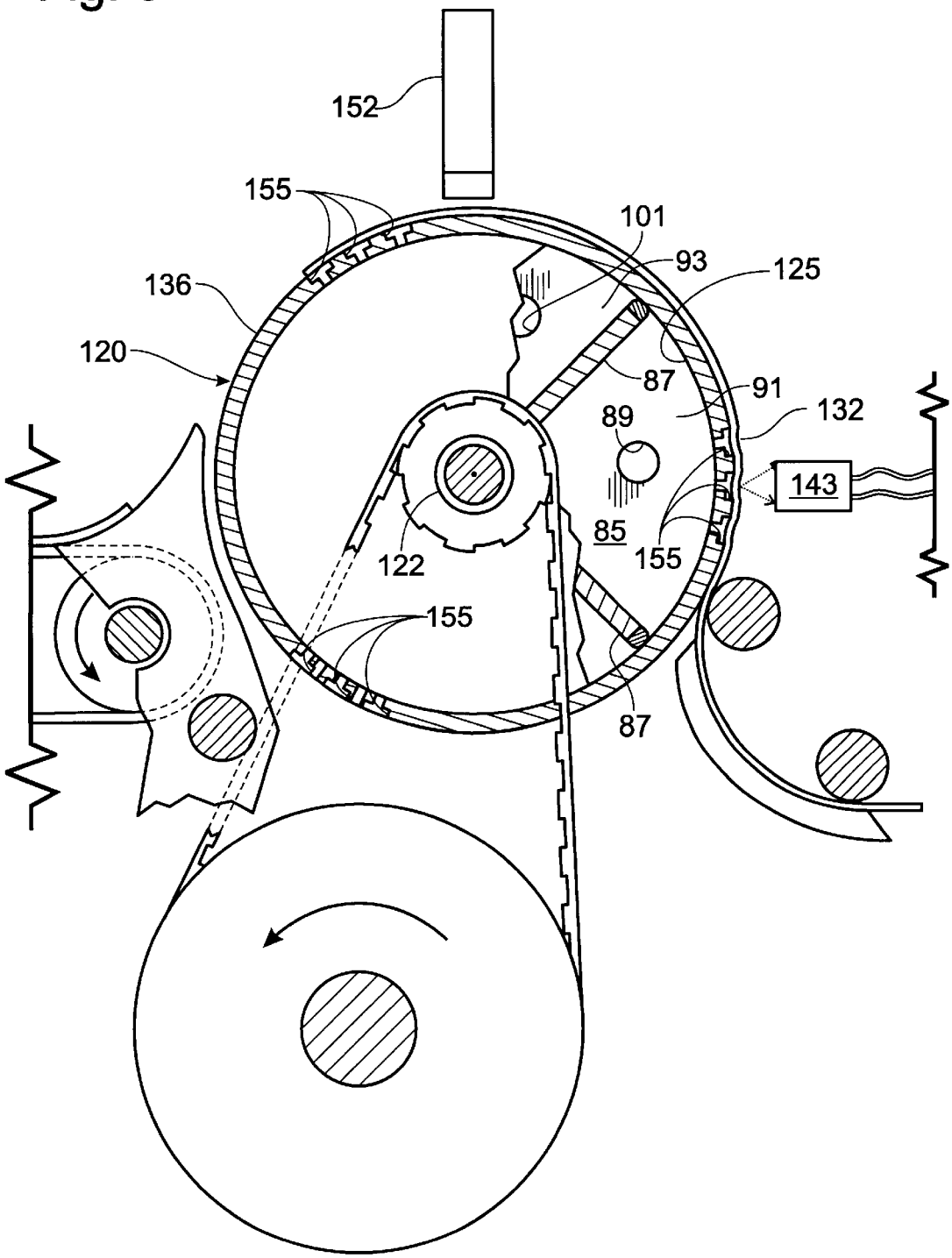
FIG. 5 is a side view of the media carrier depicting an another preferred embodiment of a media stiffness sensing station of the present invention.

FIG. 5 represents an alternative approach to the present invention whereby the deflection station is incorporated into the paper carrier component of the system. In this embodiment, the carrier is a drum 120 in which one of the flat end walls 85 is stationary. The curved surface 136 of the drum is sealed to but rotatable around the periphery of that wall 85. The other end wall of the drum is connected to a shaft and pulley arrangement for rotating the drum in a manner as described above.

A pair of partitions 87 divides the interior of the drum 120 into two sectors. The partitions are rigid plates that are fixed to the end wall 85. The inner radial edges of the partitions are formed of resilient, low friction material that makes a sealing engagement with, and slides along, the rotating shaft 122. The outer radial edges of the partitions similarly slide against the inner surface 125 of the carrier 120.

An inlet port 89 extends through the end wall 85 between the partitions 87. That port 89 is connected with the vacuum line 51 (FIG. 4.) As a result, the sector 91 of the drum interior is provided with a relatively high level of suction that, as will be explained, is useful for both loading the paper 132 onto the drum 120 and for measuring the thickness and stiffness of that paper.

In response to the thickness and stiffness measure, the controller 80 controls the vacuum applied to the other sector 93 of the drum interior. That other sector 93 is the one underlying the pens 152 of the printer and, therefore, the vacuum level within that sector 93 is controlled or regulated to remain within the desired range discussed above for removing cockle, avoiding strike through, etc., for the particular sheet of paper 132.

As shown in FIG. 5, the surface 136 of the drum 120 is provided with groups of ports and channels 155 that substantially match the port 53 and channel 55 made in the platform 47 of the previously described station 41 (FIG. 3). In one preferred embodiment, groups of the ports and channels 155 are spaced apart and distributed evenly around the surface 136 of the drum.

A sensor 143 that substantially matches the earlier-described sensor 43 is mounted to the printer and located outside the high-vacuum sector 91. The light emitter of this sensor is directed toward the drum surface and, therefore, applies on its output a stiffness signal whenever a channel 155 (with paper spanning the channel) passes next to the sensor 143.

The controller 80 receives the stiffness signal from the sensor 143. Also as the channel 155 is rotated away from the sensor 143, the beam emitted by the sensor strikes a non-deflected part of the paper 132. Thus, the sensor output alternates between the stiffness signal and the thickness signal. For a given sheet of paper, the controller treats the received signal having the greater magnitude (most deflection) as the stiffness signal and the other as the thickness signal. In instances where no paper is carried by the drum, the signal returned by the sensor is outside of a predetermined threshold (which threshold is established by a calibration process using an empty drum) and the signal is ignored.

The stiffness and thickness signals are then processed as described above to control the vacuum level in the sector 93 of the drum underlying the pen 152. In this regard an inlet 101 is provided through the end wall 85 and connected to the vacuum line 30 (FIG. 4). The suction level in sector 93, therefore, is controlled in a like manner as that of the drum interior as described above in connection with the earlier embodiment.

It will be appreciated that in the just described embodiment (FIG. 5) the high level of vacuum pressure applied to the sector 91 where the paper 132 is first brought into contact with the drum 120 is useful for ensuring that the paper is properly drawn (loaded) onto the drum. This is in addition to the use of the high-level vacuum pressure for deliberately deflecting the paper to obtain the stiffness measure.

Although a non-contact type deflection mechanism and sensor is preferred, it is contemplated that other mechanisms may be employed. For instance, a contact type mechanical probe and associated sensor is shown as an alternative embodiment in FIG. 6.

Figure 6:
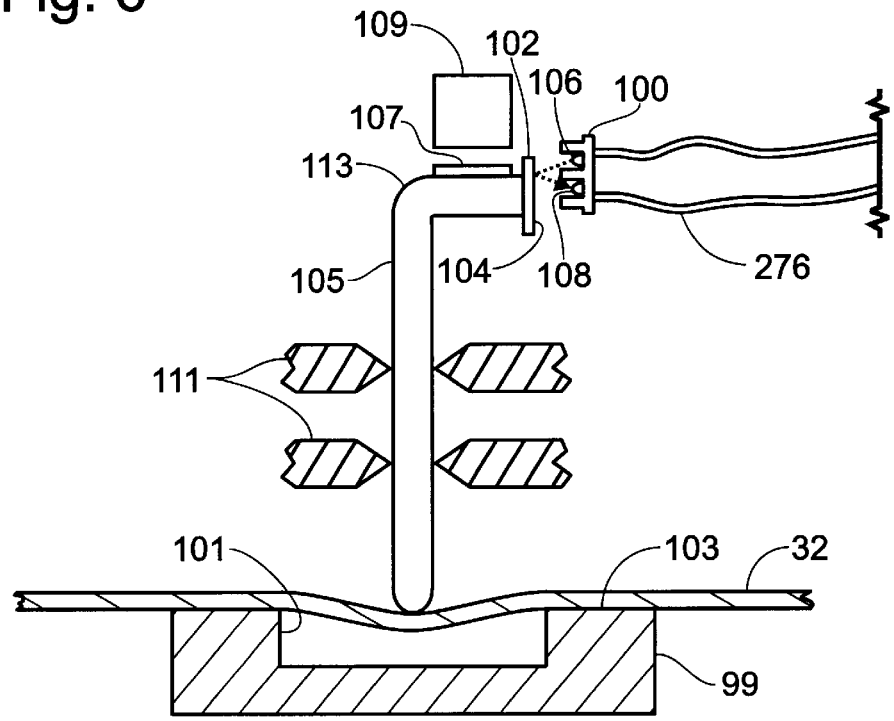
FIG. 6 is a diagram of another preferred embodiment of a media stiffness sensing technique in accord with the present invention.

The embodiment of FIG. 6 employs a platform 99 that substitutes for the platform 47 described above. No vacuum pressure is applied to this platform. Rather, a single channel 101 is formed in the upper surface 103 of the platform. The paper 32 is directed across this surface 103. An elongated probe 105 is normally suspended above the channel 101. In one embodiment a ferromagnetic part 107 of the probe is held against an electromagnet 109, that is turned on and off by the printer controller. When the electromagnet is tuned off (which occurs while the paper is beneath the probe), the probe 105 is released and moves toward the paper in a vertical path defined by annular guide members 111.

The probe weight deflects the paper 32 as the tip of the released probe contacts it. The amount of paper deflection (relating to the overall distance that the probe travels) is measured as described next.

An optical sensor 100 measures the probe movement in deflecting the paper. The upper end 113 of the probe carries a plate 102. The plate has a surface 104 that faces the emitter 106 (such as an infrared emitter) and detector 108 (such as a photodiode) of the optical sensor 100. The surface 104 is coated with reflective material in a pattern where the width of the material, hence the intensity of the emitter light reflected back to the detector, varies in the direction of movement of the probe end 113 (up and down in FIG. 6). As a result, the output from the sensor 100, which is applied to the vacuum controller (the stiffness signal) varies with the probe movement, which, as described, correlates to a preferred vacuum pressure level to be applied to the drum interior. It will be appreciated that many other mechanical type sensors can be used to deflect the paper and quantify the deflection in a manner such as just described.

Although preferred and alternative embodiments of the present invention have been described, it will be appreciated by one of ordinary skill that the spirit and scope of the invention is not limited to those embodiments, but extend to the various modifications and equivalents as defined in the appended claims.

For example, there may be fewer or more perforations or channels in the drum as compared to what is depicted in the drawings. Also, the drum need not be a rigid, cylindrical member. For instance, the drum may be more like a porous conveyor belt of any given configuration.

What is claimed is:

1. A method of regulating vacuum hold in a printer that includes a perforated carrier for supporting a sheet of print media that is carried on one side of the carrier, wherein another side of the carrier is provided with vacuum pressure for holding the sheet to the carrier, the method comprising the steps of:

deflecting part of the sheet;

sensing an amount of the deflection of the sheet;

providing a control signal indicative of the amount of the sensed deflection; and regulating the vacuum pressure in response to the control signal.

2. The method of claim 1 wherein the deflecting step includes applying a deflection vacuum pressure to the part of the sheet.

3. The method of claim 2 including the step of controlling the deflection vacuum pressure separately from the vacuum pressure that is provided on the side of the carrier.

4. The method of claim 1 wherein the sensing step includes:

locating a non-contact sensor adjacent to the deflected part of the sheet for sensing the amount of deflection.

5. The method of claim 4 wherein the sensing step includes:

directing light toward the deflected part of the sheet; and sensing light that is reflected from the deflected part of the sheet.

6. The method of claim 1 wherein the deflecting step includes deflecting the part of the sheet at a location remote from the carrier.

7. The method of claim 1 wherein the deflecting step includes deflecting the part of the sheet while the sheet is on the carrier.

8. The method of claim 1 further comprising the step of sensing the thickness of the sheet in conjunction with sensing the deflection of the part of the sheet.

9. The method of claim 8 wherein the step of sensing the thickness of the sheet includes the step of cycling on and off a deflection vacuum pressure that is applied to part of the sheet.

10. The method of claim 9 further including the step of measuring the deflection of the sheet while the deflection vacuum pressure is cycled off, thereby to obtain a measure of the thickness of the sheet.

11. The method of claim 1 wherein the regulating step includes the steps of:

providing a vacuum source for producing the vacuum pressure;

providing means for adjusting the vacuum pressure produced by the source; and adjusting the vacuum pressure in response to the control signal.

12. A vacuum hold regulation system for a printer comprising:

a carrier having a first side against which a sheet of print media is directed, the carrier including perforations;

a vacuum source connected to the carrier to provide a first level of suction on a second side of the carrier, which suction is communicated to the first side through the perforations thereby to hold to the carrier the sheet of print media that is directed to the first side of the carrier;

a regulator responsive to a control signal for regulating the first level of suction; and sensor means for sensing deflection of the sheet of print media as a second suction level is applied to a part of the sheet of print media and for providing to the regulator the control signal that is indicative of the deflection.

13. The system of claim 12 wherein the sensor means senses the deflection of the sheet of print media at a location remote from the carrier.

14. The system of claim 12 wherein the sheet of print media moves along a path to be directed against the first side of the carrier, and wherein the sensor means includes:

a station located near the carrier so that the sheet of print media is directed across the station, the station having a channel formed therein, the channel being in communication with the vacuum source for applying the second suction level to the sheet of print media through the channel thereby to deflect part of the sheet into the channel; and a sensor located sufficiently near the channel for sensing the deflection of the part of the sheet of print media.

15. The system of claim 12 wherein the sensor means includes a sensor of the type that senses the deflection of the sheet of print media without contacting the sheet.

16. The system of claim 12 wherein the second side of the carrier is divided into a first sector and separate second sector, wherein the first sector is provided with the first level of suction and the second sector is provided with the second level of suction.

17. The system of claim 16 wherein the second sector is located adjacent to a portion of the carrier against which the sheet of print media is directed onto the carrier.

18. The system of claim 12 wherein the sensor means includes:

a platform for supporting a sheet of print media, the platform having a channel formed therein such that the part of a sheet of print media is supported on the platform to span the channel, wherein the second suction level is communicated to the channel thereby to be applied to the part of the sheet of print media that spans the channel.

19. The system of claim 18 further comprising a source of vacuum pressure that provides the second level of suction to the channel, the second level being regulated separately from the first suction level.

20. The system of claim 12 wherein the sensor means includes a valve that is operable for alternatively applying and removing the second suction level so that the deflection of the sheet of print media changes such that the control signal alternatively represents the deflection and the thickness of the sheet of print media.

* * * * *